United States Patent [19]

Goller et al.

[11] Patent Number: 4,869,079

[45] Date of Patent: Sep. 26, 1989

[54] THREAD-TENSIONING AND GUIDE DEVICE FOR FLAT KNITTING MACHINES

[75] Inventors: Ernst Goller, Reutlingen; Fritz Walker, Kusterdingen, both of Fed. Rep. of Germany

[73] Assignee: H. Stoll GmbH & Co., Reutlingen, Fed. Rep. of Germany

[21] Appl. No.: 213,108

[22] Filed: Jun. 29, 1988

[30] Foreign Application Priority Data

Jul. 25, 1987 [DE] Fed. Rep. of Germany ..... 3724707

[51] Int. Cl.[4] ..... D04B 15/44

[52] U.S. Cl. ..... 66/146

[58] Field of Search ..... 66/146; 242/147; 226/195

[56] References Cited

FOREIGN PATENT DOCUMENTS 533752 9/1955 Italy ..... 66/146

387433 2/1933 United Kingdom ..... 66/146

*Primary Examiner*—Ronald Feldbaum

*Attorney, Agent, or Firm*—Larson and Taylor

[57] ABSTRACT

Thread-tensioning and guide device provided for fastening to the needle-bed ends of a flat knitting machine has, on a stationary machine part (20), a pivotably mounted supporting arm (10) for each thread to be fed, the device parts influenced by the thread to be fed being distributed to the supporting arm (10) and to the stationary machine part (20), and, in the operating position of the supporting arm (10), parts of the stationary machine part (20) interacting with elements arranged on the supporting arm or being accessible through the supporting arm for setting purposes. This design of the device allows a favorable combination of a thread-tension brake influenced by a thread-tension regulator with a specially designed pick-up tensioner.

18 Claims, 7 Drawing Sheets

THREAD-TENSIONING AND GUIDE DEVICE FOR FLAT KNITTING MACHINES

DESCRIPTION

The invention relates to a thread-tensioning and guide device for flat knitting machines, with a pick-up tensioner in the form of a spring-loaded pivoting lever which carries a thread guide member and which is arranged, together with stationary thread guide members and an adjustable thread brake preceding in the thread run-through direction, on a supporting arm pivotable out of an operating position into a threading position, and vice versa, and mounted on a stationary machine part.

A thread-tensioning device of the type mentioned in the introduction has already been proposed in German Patent Application P 36 02 431.7 and corresponding to U.S. Pat. No. 4,700,553. The arrangement of the pick-up tensioner in a pivotable supporting arm makes the thread guide members more easily accessible for drawing in a thread and ensures orderly reliable thread guidance of even an entire group of threads at the needle-bed ends of a flat knitting machine. The object on which the invention is based is to complete such a thread-tensioning and guide device in such a way that the guidance and threading of a thread become even more reliable and even easier and a reliable mode of operation of the thread-guide, thread-braking and thread-tensioning members assigned to the thread-tensioning and guide device is obtained.

According to the invention, the set object is achieved by means of a device of the type mentioned in the introduction, because parts of the device are arranged on the stationary machine part, in such a way that, in the operating position of the supporting arm, they interact with elements arranged on the supporting arm or are accessible through the supporting arm for adjustment purposes Because parts of the device are transferred to the stationary machine part, the weight of the pivotable supporting arm is kept low, its parts can be arranged more neatly and can have a more varied design, and there is a spatial distribution of the device parts which makes access to the individual parts easier and which makes it possible for the thread run to be monitored more easily. The parts arranged on the stationary machine part can advantageously be an adjusting motor for the thread brake, which interacts via a plug coupling with a regulating shaft mounted in the supporting arm, and/or a thread-tension regulator which controls the adjusting motor and the setting device of which is accessible through an orifice in the supporting arm, and/or guide and retention parts for the supporting arm. The device parts transferred to the stationary machine part can be arranged more neatly there in spatial terms and also made more operationally reliable than if they had restricted accommodation in the supporting arm. On the other hand, the device parts arranged in the supporting arm can likewise be arranged more neatly and, in particular, have a design more varied than hitherto and easy to tend. For example, the regulating shaft which can be coupled to the stationary adjusting motor and which is mounted in the supporting arm can be used to adjust a spring engaging on a pivoting lever which exerts axial pressure on a disc-shaped braking member, with the result that the width dimension of the supporting arm can be limited. This is especially important because, at the end of the needle beds, a multiplicity of supporting arms will be arranged close to one another.

The device designed according to the invention has, in the supporting arm, a whole series of features for the thread pick-up which are important for an advantageous design and for exact thread guidance and which are described herein. In the device according to the invention, the thread-tension regulator arranged, together with sensitive sensors and adjustable members, on the stationary machine part also acquires an advantageous design as a result of features which are mentioned herein.

An exemplary embodiment of a thread-tensioning and guide device for flat knitting machines which is designed according to the invention is explained in more detail below with reference to the accompanying drawing.

Figure 1:
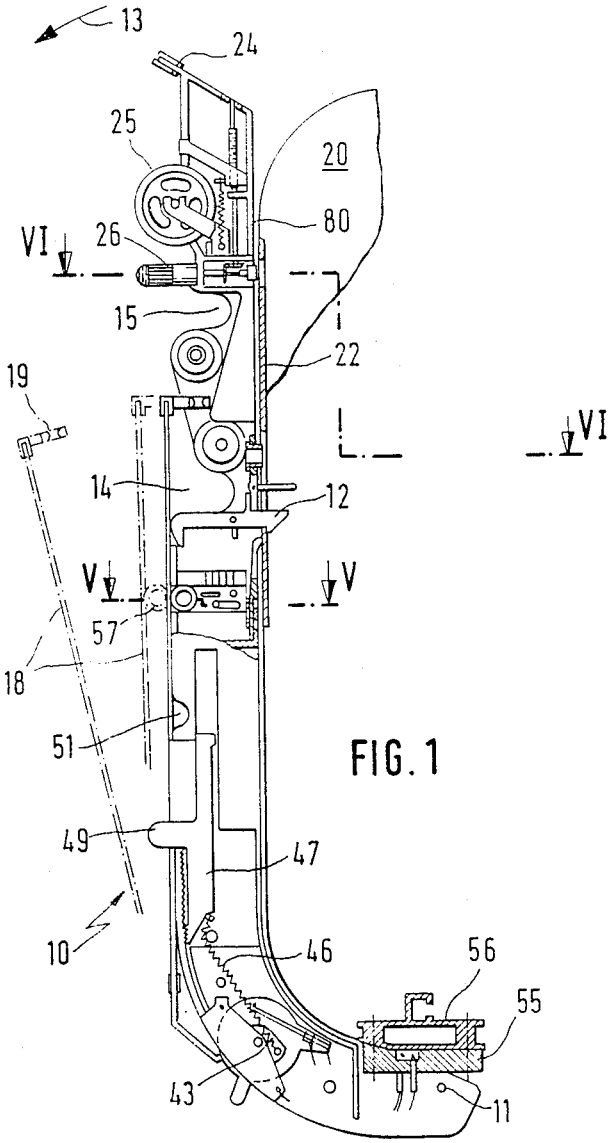
FIG. 1 shows an overall side view of the supporting arm of the device, with the side wall of the supporting-arm housing removed.

FIGS. 1 to 5 show only a supporting arm 10 which, together with several identical supporting arms arranged parallel to it, is mounted on a stationary machine part 20 so as to be pivotable about a common axle 11. The Figures each show the supporting arm 10 in its contact or operating position, in which it is locked on the edge of an orifice 21 of an adjacent wall 22 of the stationary machine part 20 by means of a detent pawl 12. After the detent pawl 12, pivotable counter to spring force, has been released, the supporting arm 10 can be swung away from the stationary machine part 20 in the direction of the arrow 13 marked in FIG. 1, so that, on the one hand, the rear side of the supporting arm 10 and, on the other hand, the stationary machine part 20 become accessible through orifices in its wall 22. The pawl 12 has the same width as the orifice 21 and therefore serves at the same time as a lateral guide element for the supporting arm 10.

A gripping part 12.1 (FIGS. 3 and 4) of the pawl 12 is accessible from an indentation 14 on the front side of the supporting arm 10. The supporting arm 10 is equipped with a further such indentation 15 which reaches into the side walls of the supporting arm and by means of which it becomes easier to introduce the thread into thread guide rollers 16 and 17, between which the thread 30, represented by a dot-and-dash line in FIG. 3, is guided through the thread guide eye 19 arranged at the end of a pivoting arm 18, consisting of a carbon-fibre bar, of the pick-up tensioner. The indentation 15 also has rounded corners 15.1, indicated in FIGS. 2 and 3, which additionally make it easier to grasp the thread during threading or after a thread break in this region. From the thread guide roller 16, the thread passes through a thread guide eye 23 of the supporting arm 10 and through the orifice 21 in the wall 22 of the stationary machine part 20, to a thread-tension regulator which is arranged there and which is described below in conjunction with FIGS. 6 and 7.

The supporting arm 10 has, at its tip, a thread guide eye 24 and, underneath this, a settable thread brake 25. The braking force of this disc brake 25 can be varied by hand at an adjusting knob 26 which is fastened on a regulating shaft 27 most clearly evident from FIG. 3. An adjusting motor 35 evident from FIG. 7 and arranged in the stationary machine part 20 can also act on this regulating shaft 27, the shaft 36 of the adjusting motor 35 ending in a plug-coupling part 37 which projects through an orifice 28 in the wall 22 of the stationary machine part 20 and which, in the contact position of the supporting arm 10, engages into a counter-coupling piece 29 fastened on the regulating shaft 27. The regulating shaft 27 is coupled, via an angular gear 31, to a screw spindle 32, by means of which a bearing part 33, to which one end of a tension spring 34 is fastened, can be adjusted. The other end of the tension spring 34 engages, on one side, on a lever 38 which is mounted in the supporting arm 10 so as to be pivotable about an axle 39 extending parallel to the regulating shaft 27 and which presses by means of its free end 38.1 on one of the two plates 25.1 of the thread brake 25. As a result of the adjustment of the bearing part 33, the force of the tension spring 34 exerted on the lever 38 is thus varied. The construction of the adjusting device makes it possible to design the supporting arm 10 with a small width, as is evident from FIG. 2. Fastened to the bearing part 33 is a pointer arm 33.1 which projects through a front-wall slot evident from FIG. 2 and which interacts with a scale 33.2, likewise evident from FIG. 2, and indicates the set braking intensity of the thread brake 25. The supporting arm 10 is open, in the region of the thread brake 25 and of its adjusting device, on its rear side facing the stationary machine part 20, so that, when the supporting arm 10 is swung away, these parts can easily be cleaned by blowing out.

Figure 3:
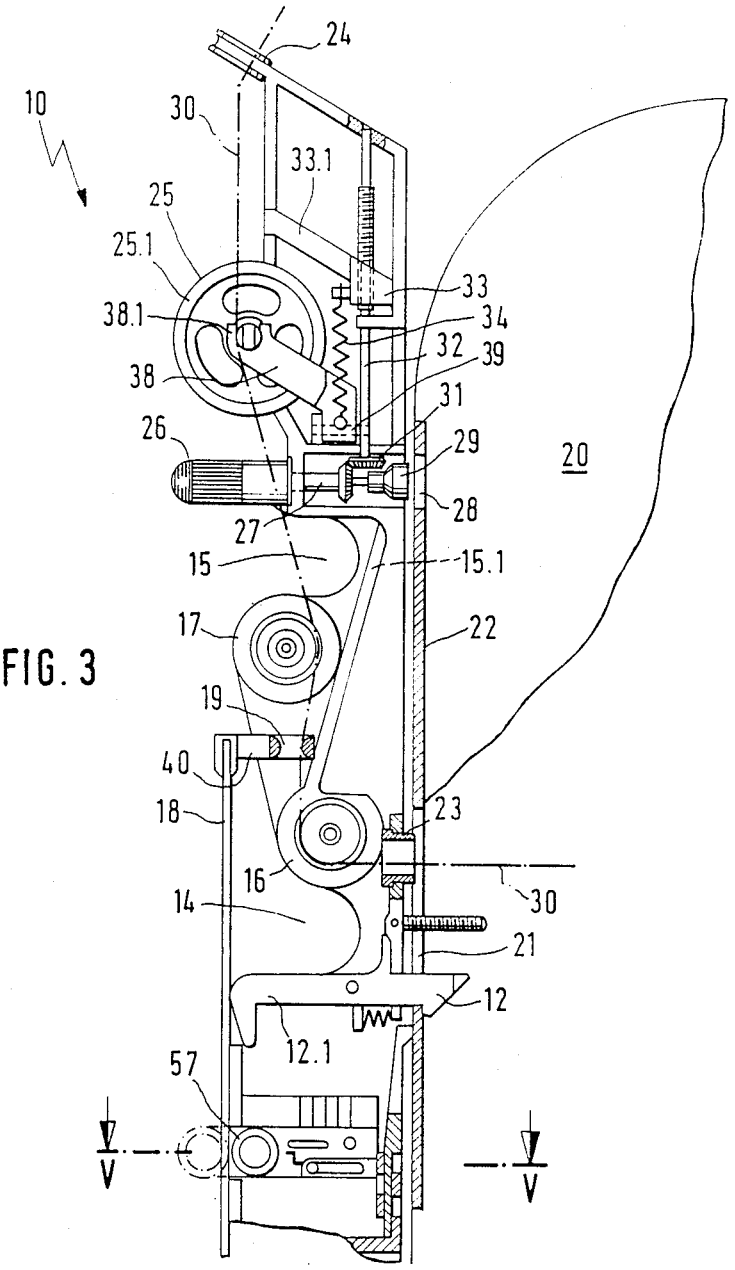
FIG. 3 shows a representation, enlarged in relation to FIG. 1, of the upper half of the side view of the supporting arm.
Figure 4:
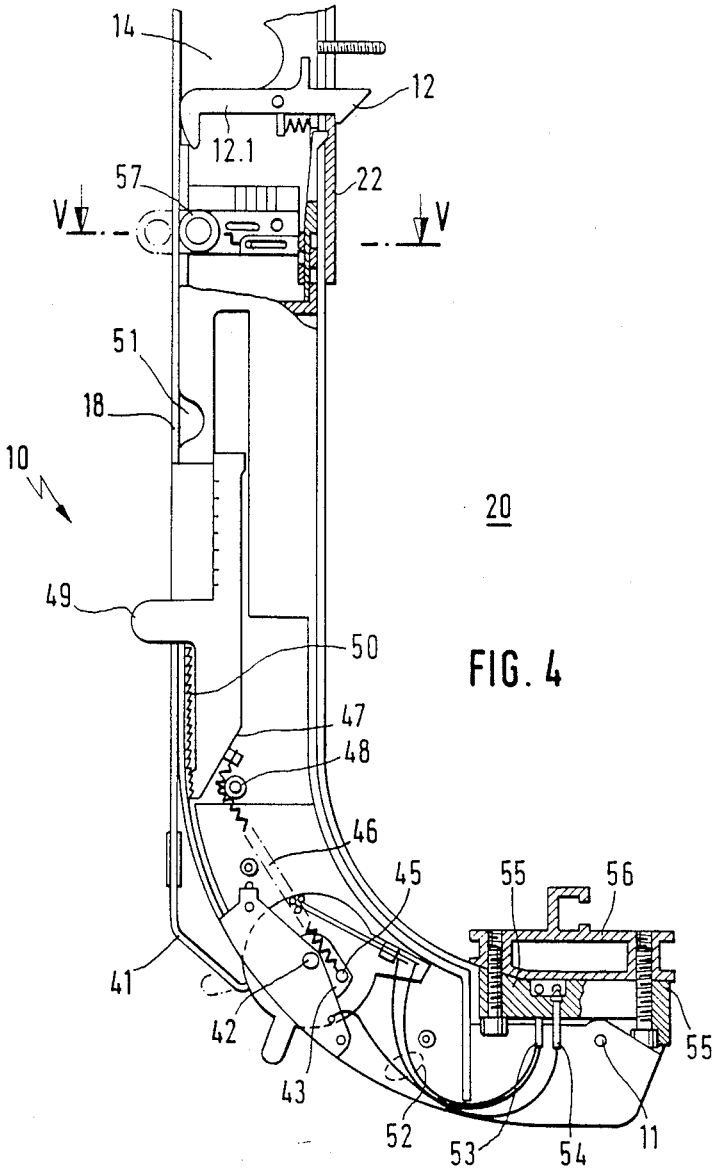
FIG. 4 shows a representation, enlarged in relation to FIG. 1, of the lower half of the side view of the supporting arm.
Figure 5:
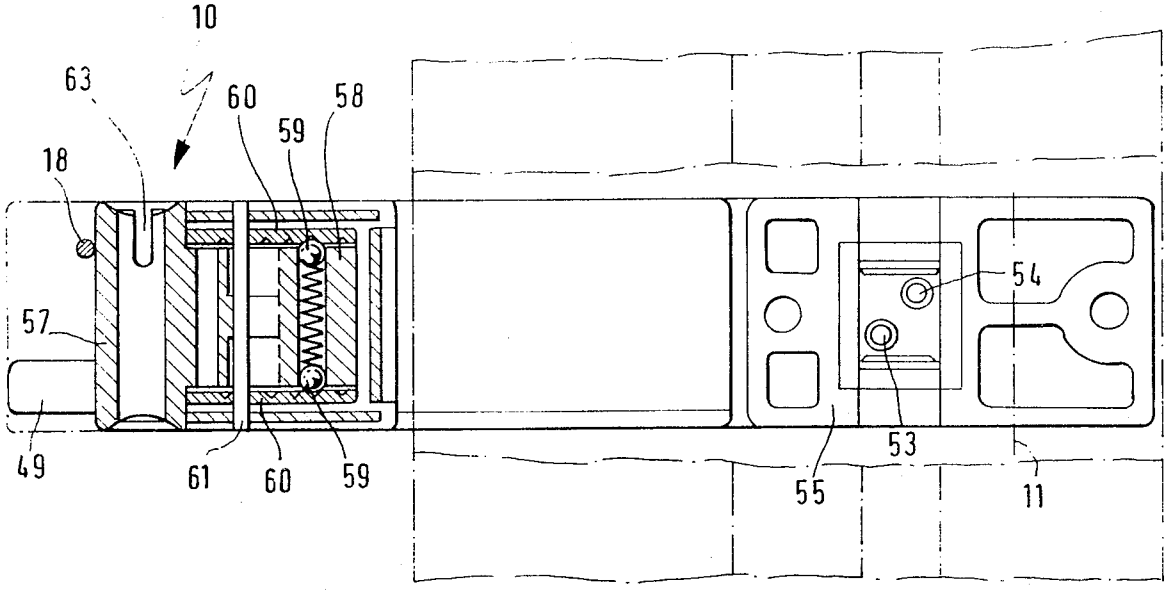
FIG. 5 shows a cross-section, enlarged in relation to FIGS. 3 and 4, through the supporting arm along the line V—V in FIGS. 1, 3 and 4.

Parts interacting with the thread pick-up are accommodated in the lower part of the supporting arm 10 particularly evident from FIG. 4. As already mentioned, the pivoting arm of the thread pick-up consists of a carbon-fibre bar 18, to the free end of which is fastened a rounded plate body 40 which is evident from FIG. 3 and into which the thread guide eye 19 is snapped exchangeably. The carbon-fibre bar 18, at its lower end, is fastened via an angled connecting bar 41 to a lever arm 43 mounted in the supporting arm 10 so as to be rotatable about an axle 42.

The lever arm 43 carries a bolt 45, to which is fastened one end of a tension spring 46, the other end of which is anchored to a tensioning slide 47 longitudinally adjustable in the housing of the supporting arm 10. The tension spring 46 is guided over a deflecting roller 48 in the region of its end fastened to the tensioning slide 47. The tensioning slide 47, which can be adjusted by means of a gripping web 49 projecting outwards through an orifice on the front side of the housing of the supporting arm 10, is equipped with catching teeth 50 which can engage into a corresponding toothed strip on the inside of the supporting arm 10. The deflection of the tension spring 46 at the roller 48 ensures that the tensioning slide 47 is pulled with its catching teeth 50 against the toothed strip as a result of the tension of the tension spring 46. To adjust the tensioning slide 47, pressure is exerted on the gripping web 40 in order to release it from the toothed strip before it is shifted in the longitudinal direction. The longitudinal adjustment of the tensioning slide 47 is assisted by a recess 51 which is formed in the front wall of the supporting arm 10 and in which one finger of the adjusting hand can be supported, whilst another finger of the latter engages on the gripping web 49 of the tensioning slide 47.

The bolt 45, on which the tension spring 46 engages, is arranged on the lever arm 43 relative to the rotary axle 42 in such a way that, in the normal position of the pivoting lever 18 of the thread pick-up, as illustrated in FIG. 4, the tension spring 46 is effective on the lever arm 43 by means of a small lever only. With a rotation of the lever arm 43 in the anti-clockwise direction during the pivoting of the pivoting lever 18 consisting of a carbon-fibre bar, as shown in FIG. 1, the lever arm under which the tension spring 46 engages on the lever arm 43 becomes increasingly large. The spring force which, during this pivoting movement, becomes less as a result of a shortening of the spring 46 is therefore associated with an increase in the effective lever on the lever arm 43, with the result that, over the entire pivoting travel of the pivoting lever 18, an at least approximately constant torque is effective on the pivoting lever, and consequently the thread 30 remains exposed to a uniform tensile stress.

Arranged on the lever arm 43 in a way known per se are sensors or switching elements of the control device of the flat knitting machine, which interact with stationary control members or limit switches, in order to trigger a fault indication and/or a cut-off of the machine in the event of an excessive swing-out of the pivoting lever 18 of the thread pick-up caused by thread break. FIG. 4 shows the current leads 52 leading to these thread-monitoring members and ending at two contact pins 53 and 54 arranged in a separate supporting-arm attachment 55, hatched in FIG. 4, which is mounted on the supporting-arm housing so as to be pivotable to a limited extent about the pivot axle 11 of the supporting arm 10 and which can be screwed to a conductor carrier rail 56 of the flat knitting machine.

Figure 2:
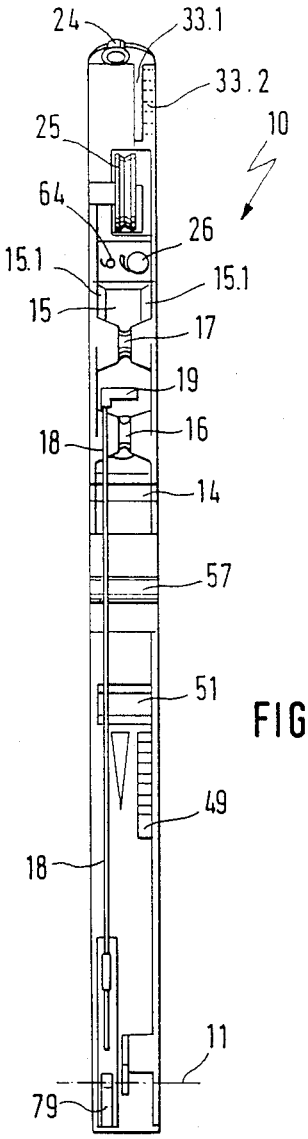
FIG. 2 shows an overall front view of the supporting arm.

FIG. 2 shows, at the lower end of the supporting arm 10, a resilient stop part 79 of the front housing wall, against which the connecting bar 41 butts in the event of a thread break and thereby experiences shock absorption. In order to prevent vibrations of the pivoting lever 18 as a result of fluctuations in the thread pull in the normal operating position of the pivoting lever 18 shown in FIG. 4, a stop web 57 adjustable as a function of the type of thread 30 guided is arranged in the middle region of the supporting arm 10. Its mounting is evident from the sectional representation in FIG. 5. It is equipped with a supporting body 58, in which are arranged spring-loaded detent balls 59 which interact with detent strips 60 connected firmly to the supporting arm. The stop web 57, at one end, has a groove 63, evident from FIG. 5, into which the carbon-fibre bar 18 can be pushed when the pick-up tensioner is to be rendered inoperative.

Figure 6:
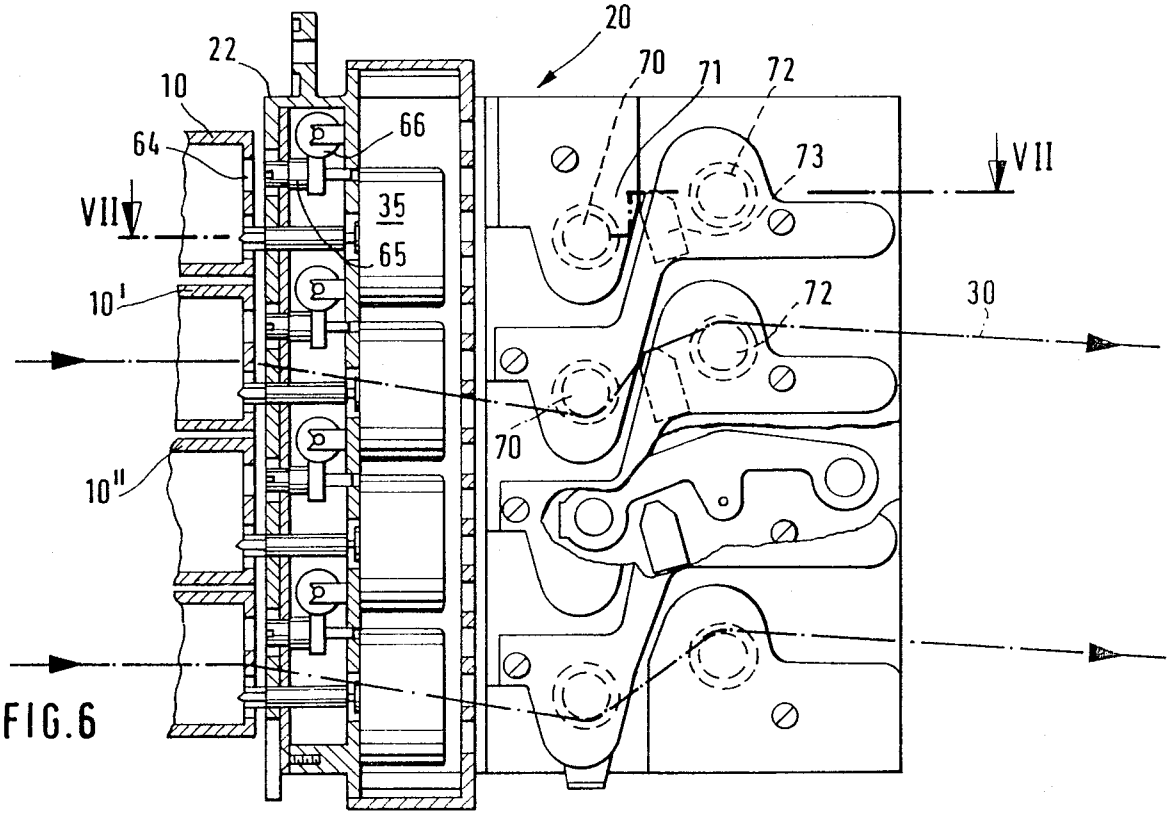
FIG. 6 shows a cross-section along the line VI—VI in FIG. 1 through an arrangement of four supporting arms and the associated stationary machine part of the device.
Figure 7:
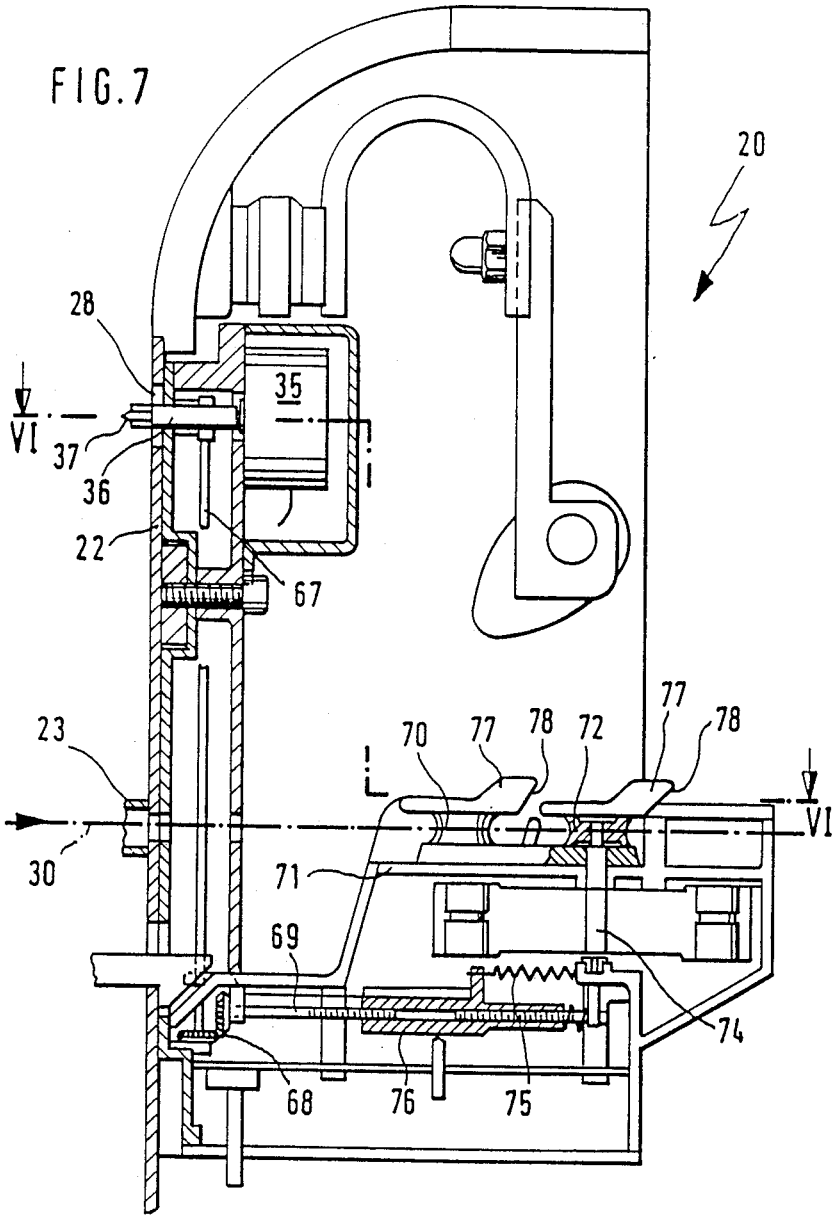
FIG. 7 shows a part longitudinal section through the stationary machine part of the device along the line VII—VII in FIG. 6.

FIGS. 6 and 7 show sections through the stationary machine part 20. The sectional representation of FIG. 6 illustrates several supporting arms 10, 10', 10'' mounted pivotably on the stationary machine part 20. Each supporting arm 10 has, next to a rotary handle 26, a housing passage orifice 64, of which the front end is shown in FIG. 2 and the rear end is shown in FIG. 6. The housing passage orifice 64 makes it possible to introduce a screwdriver up to a regulating shaft 65 mounted in the wall 22 of the stationary housing part 20 behind each supporting arm 10. The regulating shaft 65 is coupled, via angular-drive gearwheels 66, to a connecting shaft 67, evident from FIG. 7, which is mounted in the stationary housing part 20 parallel to the associated supporting arm 10 and which, at its lower end, is coupled, in turn, via an angular gear 68 to an adjusting spindle 69 extending parallel to the regulating shaft 65 and intended for a thread-tension regulator. The thread-tension regulator has, level with the thread guide eye 23 of the associated supporting arm 10, a thread deflection roller 70, which is arranged on a pivoting lever 71 evident from FIG. 7, and a stationary thread deflection roller 72 arranged behind it in the thread run-through direction. A thread-run sensor 73 is arranged between the pivotably arranged thread deflection roller 70 and the stationary thread deflection roller 72. The pivoting lever 71 carrying the deflection roller 70 is mounted rotatably about the axle 74 and is under the prestress of a tension spring 75 which is fastened at one end to the pivoting lever 71 and at its other end to a bearing part 76 adjustable by means of the adjusting spindle 69 in order to change the spring prestress. The pivoting lever 71 interacts, in a way known per se and not shown in more detail here, with sensors which, as a function of its pivoting position which depends on the tension of the thread 30 guided over the thread deflection roller 70, trigger adjusting signals to the adjusting motor 35 for the thread brake 25 via the control device of the flat knitting machine. The adjustment plane of the pivoting lever 71 carrying the thread deflection roller 70 extends perpendicularly relative to the longitudinal direction of the associated supporting arm 10, so that the thread can be inserted into the thread-tension regulator from above. Insertion is assisted by tongue-like yokes 77, evident from FIG. 7, which are located on the thread deflection rollers 70 and 72 and which each have a sloping thread slip-in surface 78.

We claim:

1. A thread tensioning and guide device for a thread in a flat knitting machine having a stationary machine part, said device comprising:

a supporting arm which is pivotably mounted on the stationary machine part to be pivotable between an operating position and a threading position;

a pick-up tensioner for the thread including (a) a spring-loaded pivoting lever pivotally mounted on the supporting arm, (b) a movable thread guide member which is carried on the pivoting lever, and (c) stationary thread guide members mounted on the supporting arm on respective sides of the movable thread guide member;

an adjustable thread brake means preceding the pick-up tensioner in a thread run-through direction for adjusting a braking on the thread, the thread brake means including an adjustable thread brake and associated regulating shaft mounted on the supporting arm, an adjusting motor mounted on the stationary machine part, a detachable coupling means for detachably coupling the adjusting motor to the regulating shaft, a thread tension regulator means for controlling the adjusting motor which is mounted on the stationary machine part, a setting means for setting the tension for the thread tension regulator means which is mounted on the stationary machine part, and an orifice in the supporting arm for providing access to the setting means; and a guide and retention means for releasably retaining the supporting arm in position on the stationary machine part.

2. Device according to claim 1, characterized in that the regulating shaft (27) serves for adjusting a spring (34) engaging on a second pivoting lever (38) which exerts axial pressure on a disc-shaped braking member (25.1) of the thread brake.

3. Device according to claim 2, characterized in that the position of a spring bearing part (33) adjustable in a self-locking manner by means of the regulating shaft (27) can be read off on an external scale (33.2) of the supporting arm (10).

4. Device according to claim 1, characterized in that the thread-tension regulator means has a pivotable thread deflection roller (70) which is arranged on a second spring-loaded pivoting lever (71) equipped with sensors of a control device and which is arranged between two other thread guide members (23, 72), and in that the first (23) of the other two thread guide members is arranged on the supporting arm (10) while the pivotable thread deflection roller (70) and the second other thread guide member (72) are arranged on the stationary machine part (20), and the two other thread guide members (23, 72) and pivotable thread deflection roller (70) of the thread-tension regulator are in a plane which extends transversely relative to the longitudinal direction of the supporting arm (10).

5. Device according to claim 4, characterized in that the setting means (65-69) which adjusts a spring (75) acting on the second pivoting lever (71) of the thread-tension regulator means has at least one angular drive (66, 68), a connecting shaft (67) with ends, and an adjustable bearing part (76) for the tension spring (75) of the second pivoting lever (71) with one end of the connecting shaft operatively coupled to the adjusting part and the other end operatively coupled to the regulating shaft (65), such that to the other end a tool is guided through the orifice (64) in the supporting arm (10) for adjusting the spring (75).

6. Device according to claim 4, characterized in that a tongue-like guide body (77) having a sloping thread slip-in surface (78) leading to the deflection roller is arranged as a threading aid above the pivotable thread deflection roller (70).

7. Device according to claim 4, characterized in that a thread-run sensor (73) is additionally arranged in the thread-tension regulator means between the pivotable thread deflection roller (70) and the second other thread guide member (72).

8. Device according to claim 1, characterized in that curved wall clearances (14, 15) making it easier to grasp the thread (30) during insertion are formed on the supporting arm (10) on both sides of the stationary thread guide members (16, 17).

9. Device according to claim 1, characterized in that the movable thread guide member is a thread guide eye (19), and the supporting arm has an adjustable vibration-damping stop (57) which is additionally equipped with a lateral groove (63) for suspending the pivoting lever (18) when there is no thread guidance.

10. Device according to claim 9, characterized in that the supporting arm (10) has a second stop (79) which serves as a shock absorber for the pivoting lever (18), swinging outwards in the event of a thread break, of the pick-up tensioner and which is formed by a resilient wall part.

11. Device according to claim 1, characterized in that a spring (46) acting on the pivoting lever (18) of the pick-up tensioner is designed as a tension spring which, at one end, is anchored to a lever arm (43) connected to the pivoting lever, to obtain a uniform lever load over the entire pivoting range, in such a way that its anchoring point (45) produces the smallest lever arm when the pivoting lever (18) is swung inwards and there is maximum spring extension and the largest lever arm when the pivoting lever is swung out completely and there is minimum spring extension.

12. Device according to claim 11, characterized in that the tension spring (46) for the pick-up tensioner is fastened, at its other end, to a tensioning slide (47) adjustable in the supporting arm (10) and engageable in different positions, in such a way that it loads the tensioning slide in the direction of engagement.

13. Device according to claim 12, characterized in that, at least at one end of the path of adjustment for the tensioning slide (47), there is formed on the supporting arm (10) a gripping recess (51), in which, during adjustment, one finger of a hand can be supported, whilst another finger of the latter engages on a gripping web (49) of the tensioning slide (47).

14. Device according to claim 1, characterized in that the pivoting lever (18) of the pick-up tensioner consists of a carbon-fibre bar.

15. Device according to claim 1, characterized in that the movable thread guide member is a rounded plate body (40) fastened eccentrically to a free end of the pivoting lever (18) of the pick-up tensioner which has an orifice for the exchangeable snapping in of a thread guide eye (19).

16. Device according to claim 1, characterized in that the guide and retention means includes a wide detent pawl (12) on the supporting arm which engages into a wall orifice (21) of the same width in the stationary machine part (20) for the lateral guidance and locking of the supporting arm (10).

17. Device according to claim 1, characterized in that articulated on the supporting arm (10) in the region of its bearing point (11) formed on the stationary machine part (20) is an attachment (55) which is equipped with electrical connecting contacts (53, 54) and which can be connected to a conductor carrier rail (56) of the flat knitting machine.

18. Device according to claim 1, characterized in that the supporting arm (10), on its side facing the stationary machine part, has, in the region of the thread brake, a cleaning orifice (80) which exposes the thread brake means for air cleaning.

* * * * *